US006200065B1

(12) United States Patent
Eitzen

(10) Patent No.: US 6,200,065 B1
(45) Date of Patent: Mar. 13, 2001

(54) LIGHTWEIGHT, PORTABLE VIBRATORY SCREED

(76) Inventor: R. Wayne Eitzen, #1 Sawston La., Bella Vista, AR (US) 72714-4321

( * ) Notice: Subject to any disclaimer, the term of this patent is extended or adjusted under 35 U.S.C. 154(b) by 0 days.

(21) Appl. No.: 09/360,228

(22) Filed: Jul. 23, 1999

Related U.S. Application Data

(60) Provisional application No. 60/093,955, filed on Jul. 23, 1999.

(51) Int. Cl.[7] ..... E01C 19/38; E01C 19/22

(52) U.S. Cl. ..... 404/114; 404/118; 404/133.1

(58) Field of Search ..... 404/97, 114, 133.1, 404/118; 15/235.4, 235.8

(56) References Cited

U.S. PATENT DOCUMENTS

| | | | | |
|---|---|---|---|---|
| 4,213,749 | | 7/1980 | Morrison | 425/456 |
| 4,701,071 | | 10/1987 | Morrison | 404/114 |
| 4,752,156 | | 6/1988 | Owens | 404/118 |
| 4,798,494 | | 1/1989 | Allen | 404/114 |
| 4,838,730 | | 6/1989 | Owens | 404/114 |
| 5,540,519 | | 7/1996 | Weber | 404/102 |
| 5,857,803 | * | 1/1999 | Davis et al. . | |
| 5,980,154 | * | 11/1999 | Record . | |

* cited by examiner

*Primary Examiner*—Eileen D. Lillis
*Assistant Examiner*—Gary S. Hartmann
(74) *Attorney, Agent, or Firm*—Head Johnson & Kachigian; Trent Keisling

(57) ABSTRACT

The screed includes an elongated blade vibrated by a centrally located, eccentric weight. The blade is supported by an elongated shaft extending to a power source that drives the weight. An associated operator handle facilitates convenient manipulation of the screed. A unique vibration dispersion system enables the centrally located weight to effectively vibrate the entire blade length. The dispersion system includes an elongated, rigid integral brace extending the entire blade length. The brace secures to the eccentric weight via a vibratory housing. Vibrations from the housing force the blade to vibrate violently to consolidate the plastic concrete. As the screed is drawn across wet plastic concrete, it simultaneously consolidates the concrete by vibrating it thoroughly throughout the monolith while also striking off and levelling the top layer of the concrete. The screed includes a pivoting kickstand that enables the operator to quickly release the screed without significant departure from the present screed angle and without requiring engine shut-off. During use, the operator may deploy the kickstand and then simply drop the screed handles to engage the kickstand and thereby support the screed on both the kickstand and the blade. The entire handle assembly is preferably adjustable to accommodate operators of varying heights as well as various depths of concrete. The vibratory dispersal system includes a multiple component clamp that secures the blade to the vibratory assembly to transfer vibrations from the eccentric weight across the blade. Central portions of the brace are captivated by respective clamp sections.

10 Claims, 4 Drawing Sheets

LIGHTWEIGHT, PORTABLE VIBRATORY SCREED

CROSS REFERENCE TO RELATED APPLICATION

This application is a continuation-in-part of U.S. provisional patent application Ser. No. 60/093,955 entitled Lightweight, Portable Vibratory Screed filed on Jul. 23, 1999.

BACKGROUND OF THE INVENTION

1. Field of the Invention

The present invention relates generally to concrete screeds for consolidating and placing plastic concrete. In particular, the present invention relates to a lightweight, portable vibratory wet screed for leveling and consolidating plastic concrete. Relevant art may be found in U.S. Class 404, subclasses 101, 114, 115, as well as others.

2. Known Art

As will be appreciated by those skilled in the art, wet or plastic concrete must be worked before it sets and forms a hardened slab. Working plastic concrete generally involves consolidating the plastic concrete to evenly distribute water and aggregates throughout the resulting monolith and, subsequently, leveling the consolidated plastic concrete to appropriately contour the top layer of the plastic concrete.

Consolidating plastic concrete is often performed by vibrating the plastic concrete to evenly distribute water and aggregate materials throughout the monolith of concrete. The vibrations also fracture air pockets trapped inside the monolith and permit the air to escape therefrom. Other pockets of materials, such as sand and gravel or the like, are also shattered so that their components may be more evenly distributed throughout the monolith.

Several tools have been previously proposed for working plastic concrete. These tools include screeds, trowels (both manual and self-propelled), and placing tools such as floating pans and the like. Of the former, screeds with strike-offs are commonly employed during initial plastic concrete consolidation while the latter are typically used to finish the top surface of the concrete to a desired smoothness.

Screeds may generally be grouped as a)single operator tool, b) multiple operator tool, c) or a form riding tool. Screeds with strike-offs are normally employed in "wet" plastic concrete to initially level and consolidate the monolith because the wet plastic concrete typically will not support heavy weights. ("Wet" plastic concrete generally has a slump of between three and ten inches.)

Form riding tools are typically at least ten feet in length and ride upon the forms bounding the concrete monolith. These form-riding screeds and strike-offs are usually pulled along the form by a series of cables or the like and generally employ remote power to vibrate the blade. An example of a conventional form-riding screed is shown in U.S. Pat. No. 4,213,749.

Multiple operator screeds are shown in U.S. Pat. Nos. 4,798,494; 4,838,730; 4,752,156; and 4,701,071. These devices generally strike-off, vibrate and level plastic concrete in a single pass. They may employ remote power and are typically drawn through plastic concrete by multiple operators. However, they are large and unwieldy and they often require excessive site preparation and cannot be moved quickly about the pour. These devices also suffer from other handicaps associated with maintenance and the like.

Single operator screeds are often employed to strike-off, vibrate, and level plastic concrete in a single pass without form support. The portable nature of these devices permits their use about pour sites with minimal preparation and they are easy to transport. These devices are often advantageous in that they do not require significant preparation time and/or transport logistics. They are also highly maneuverable and typically require less maintenance than their larger counterparts.

U.S. Pat. No. 5,540,519 shows a portable, vibratory wet screed, the teachings of which are hereby expressly incorporated by reference. The portable screed shown therein is adapted to strike-off, vibrate and level wet concrete quickly and efficiently. However, the device is often subject to undesirable downtime at the pour site as a result of its complex vibratory dispersion system. Further, the invention is prone to suffer from undesirable penetration of the gear box structure resulting from the placement of the gearbox in the screed bar.

Thus, there exists a need in the art for a portable vibratory screed that may be easily transported about a pour site with minimal preparation to consolidate and level plastic concrete. In particular, a desirable device would enable an operator to begin levelling wet, plastic concrete immediately after pouring. A particularly advantageous device would use a dependable vibratory dispersion system to prevent undesirable down time while promoting efficient concrete consolidation and levelling.

SUMMARY OF THE INVENTION

The present lightweight, portable vibratory screed addresses the problems associated with the known art. The portable screed of the present invention provides a dependable, vibratory dispersion system that promotes reliability during the critical plastic period for concrete placing. The portable screed of the present invention may be easily transported about a construction site and requires minimal preparation for use. Maintenance of the present screed invention is minimal as well.

The lightweight, portable vibratory screed includes an elongated blade vibrated by a centrally located, eccentric weight. The blade is supported by an elongated shaft extending to a power source (preferably an internal combustion engine) that drives the weight. An associated operator handle facilitates convenient manipulation of the screed.

A unique vibration dispersion system enables the centrally located weight to effectively vibrate the entire blade length. The dispersion system includes an elongated, rigid integral tube extending the entire blade length. The tube secures to the eccentric weight via a vibratory housing. The vibratory housing transfers weight vibrations directly to the middle portion of the tubing. These transferred vibrations force the blade to vibrate violently to consolidate the plastic concrete as the screed moves over the concrete monolith. Thus, as the screed is drawn across wet plastic concrete, it simultaneously consolidates the concrete by vibrating it thoroughly throughout the monolith while also striking off and levelling the top layer of the concrete.

In a particular embodiment, the screed includes a pivoting kickstand that enables the operator to quickly release the screed without significant departure from the present screed angle and without requiring engine shut-off.

During use, the operator may deploy the kickstand and then simply drop the screed handles to engage the kickstand and thereby support the screed on both the kickstand and the blade. The engine may remain on without harm to the concrete. In a preferred deployment, the kickstand engagement does not substantially alter the angular attitude of the blade with respect to the freshly levelled wet plastic concrete. The entire handle assembly is preferably adjustable to accommodate operators of varying heights as well as various depths of concrete.

The vibratory dispersal system includes a multiple component clamp that secures the blade to the vibratory assembly to transfer vibrations from the eccentric weight across the blade. The blade preferably includes an elongated tubular channel extending substantially across the entire upper length of the blade. In a particular embodiment, central portions of the tubular channel are captivated by respective clamp sections. Ideally, the clamp sections are secured directly to the tubular channel.

Thus, a principle object of the present invention is to provide a lightweight, portable vibratory screed that may be employed upon wet plastic concrete to simultaneously consolidate and level the plastic concrete.

A basic object of the present invention is to provide a vibratory portable screed that may be easily transported about a construction site to consolidate and level freshly poured concrete.

A related object of the present invention is to provide an improved vibratory screed with a simplified and durable fully enclosed and water tight vibratory dispersal system that enhances and distributes vibrations directly to the screed blade.

A related object of the present invention is to provide a vibratory screed that is durable and essentially maintenance-free.

An object of the present invention is to provide a portable screed that may be deployed upon freshly poured wet plastic concrete with minimal preparation.

Yet another basic object of the present invention is to provide a portable screed that may be immediately dropped by the operator without harming previously consolidated and levelled plastic concrete.

A related object of the present invention is to provide a portable screed that may be momentarily dropped without requiring engine termination.

A basic object of the present invention is to provide a dependable screed that may be used to efficiently consolidate and level plastic concrete easily and efficiently by a single operator.

DETAILED DESCRIPTION OF THE PREFERRED EMBODIMENTS

The screed invention is an extremely lightweight (preferably approximately 40 lbs.), single operator, power vibratory wet screed used to place concrete. The present screed invention can operate in slumps of 4.5" to 10". The screed employs a unique design with a fully enclosed, water tight 5.5" wide screed bar that is capable of cutting the concrete to grade as the harmonic vibratory action through the entire screed bar (produced by the eccentric positioned at a 30° angle to the surface) simultaneously provides a hammering effect on the concrete. The unique design of the screed bar also assures maintaining a straight flat bar capable of producing a level job.

The unique design of the screed and combination of lightweight, wide screed bar with cutting face and dual action vibration completely consolidates the concrete, distributing the aggregate and the water evenly throughout the slab. Additionally, the dual action harmonic vibration combined with rapid tamping breaks down the air bubbles in the concrete to less than 3/16" pockets to eliminate voids without additional external vibration. The exceptionally durable screed is extremely tough while retaining simple construction to prevent down time during the critical pour period when breakdowns are extremely costly.

The consolidation of the concrete to evenly distribute the aggregate and produce a uniform water concentration throughout the slab while simultaneously breaking down the air bubbles produces a slab that cures evenly, thus producing a superior product with extremely high cure strength.

Figure 1:
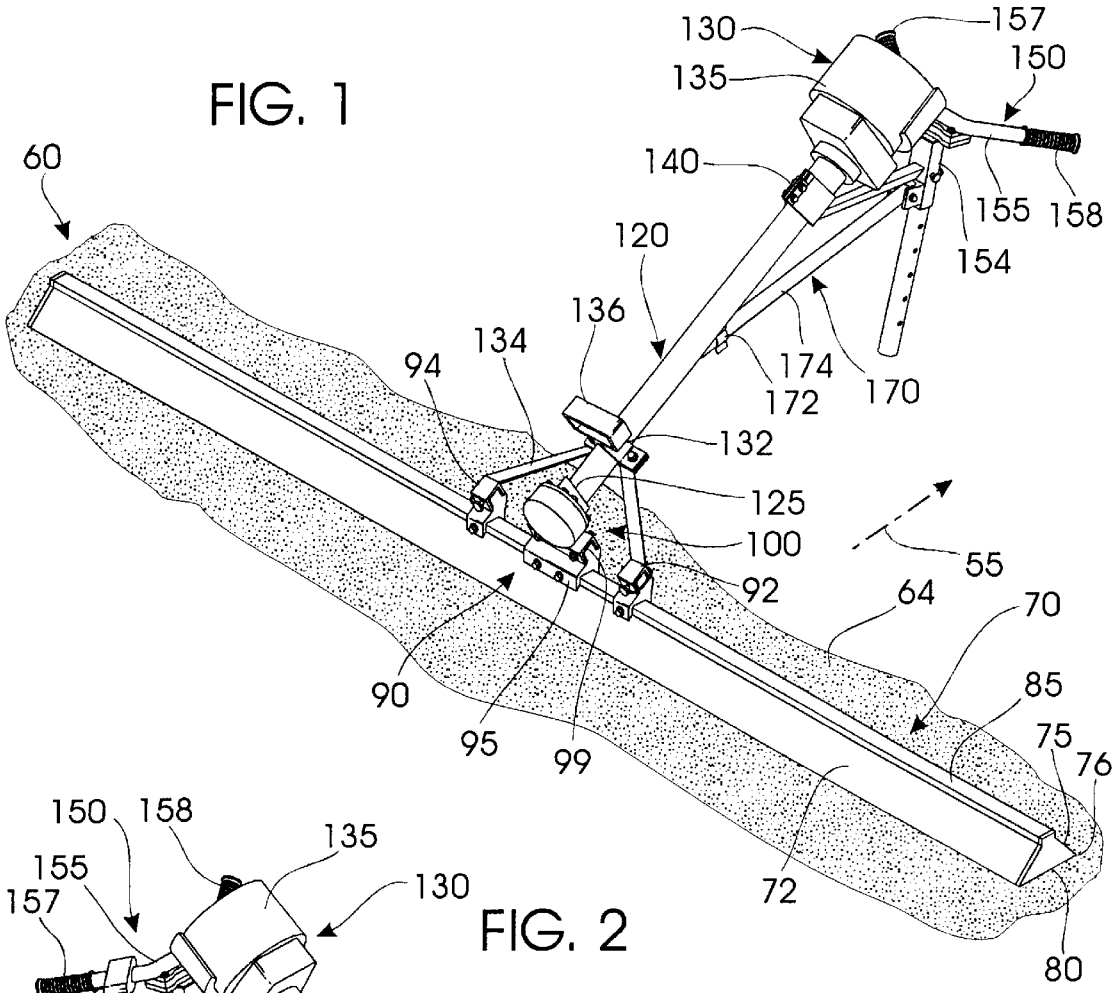
FIG. 1 is an isometric view of an exemplary embodiment of a lightweight, portable vibratory screed according to the present invention, taken generally from the right.
Figure 2:
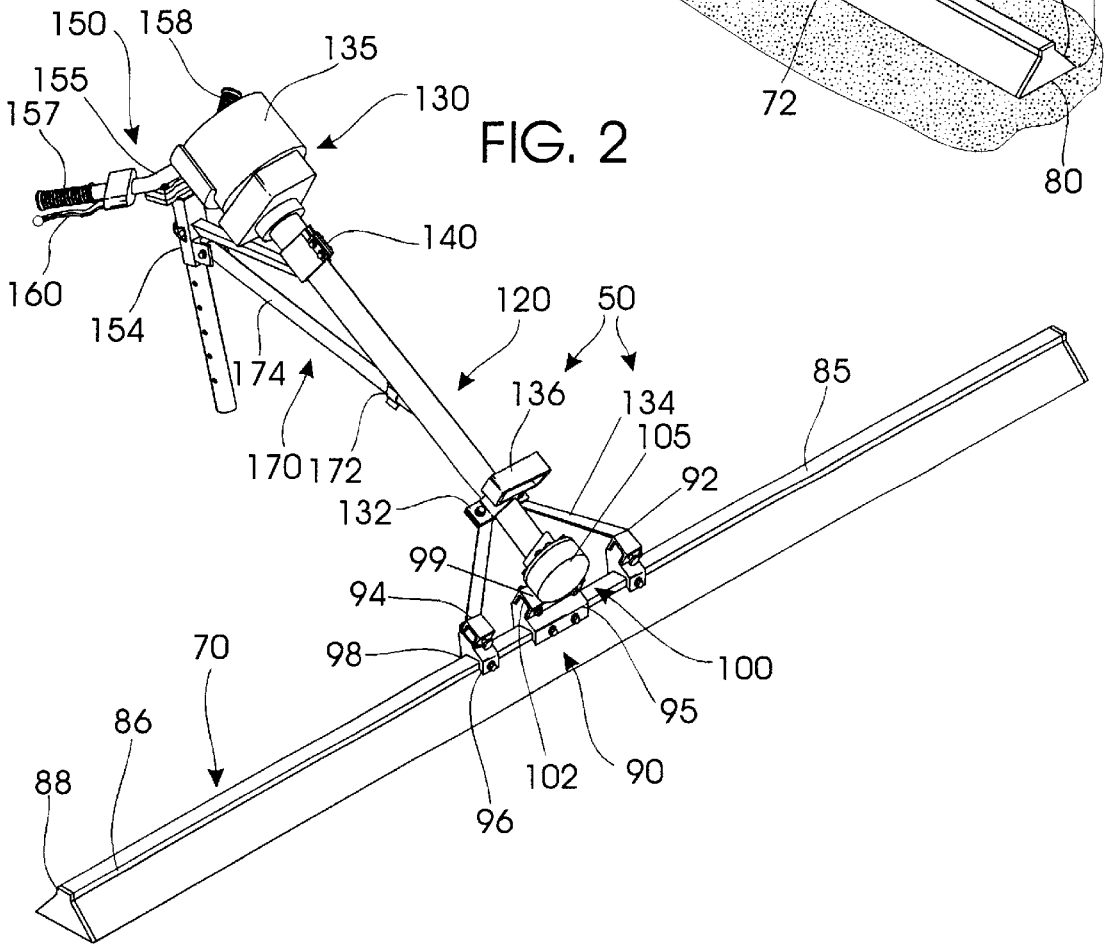
FIG. 2 is an isometric view of the invention, taken generally from the left.

Referring now to the above described Figures, particularly FIGS. 1 and 2, an exemplary embodiment of the improved lightweight, portable vibratory screed is generally designated by the reference numeral 50. The screed 50 is adapted to be used by a single operator to consolidate and level freshly poured, wet plastic concrete.

Figure 3:
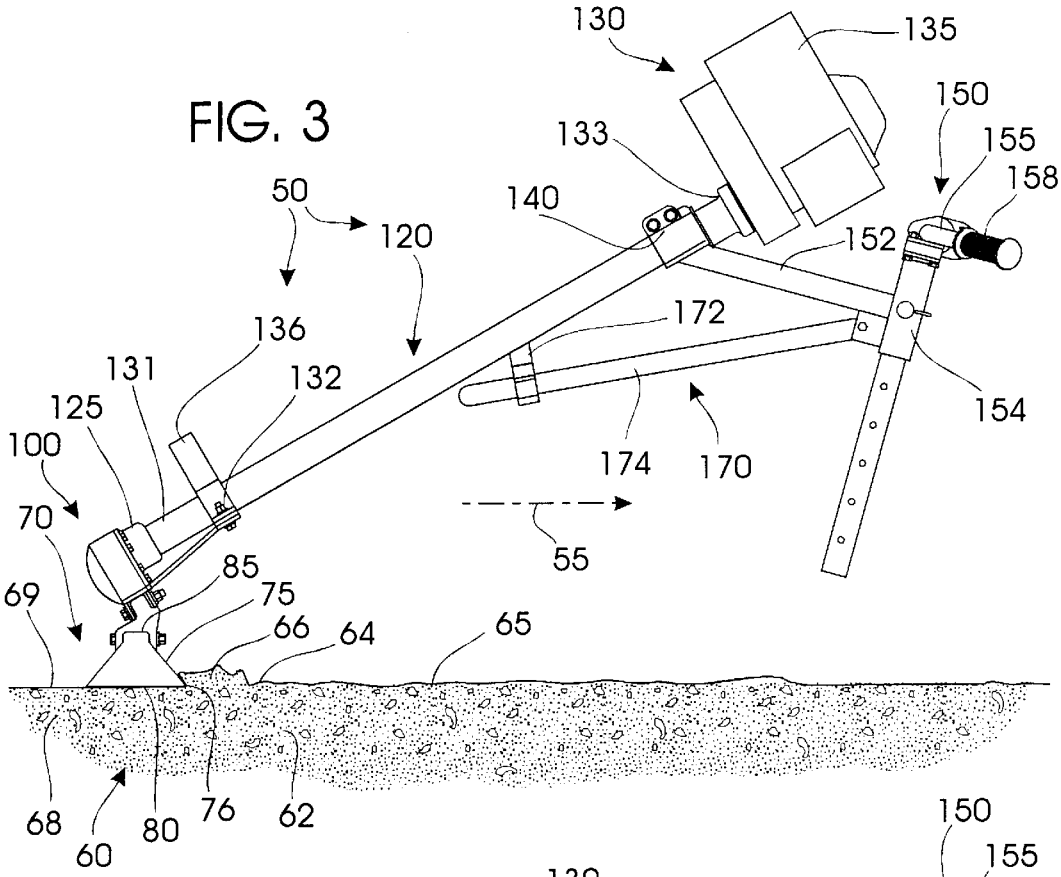
FIG. 3 is a side elevational view of the invention depicting the screed used to consolidate and level plastic concrete.
Figure 4:
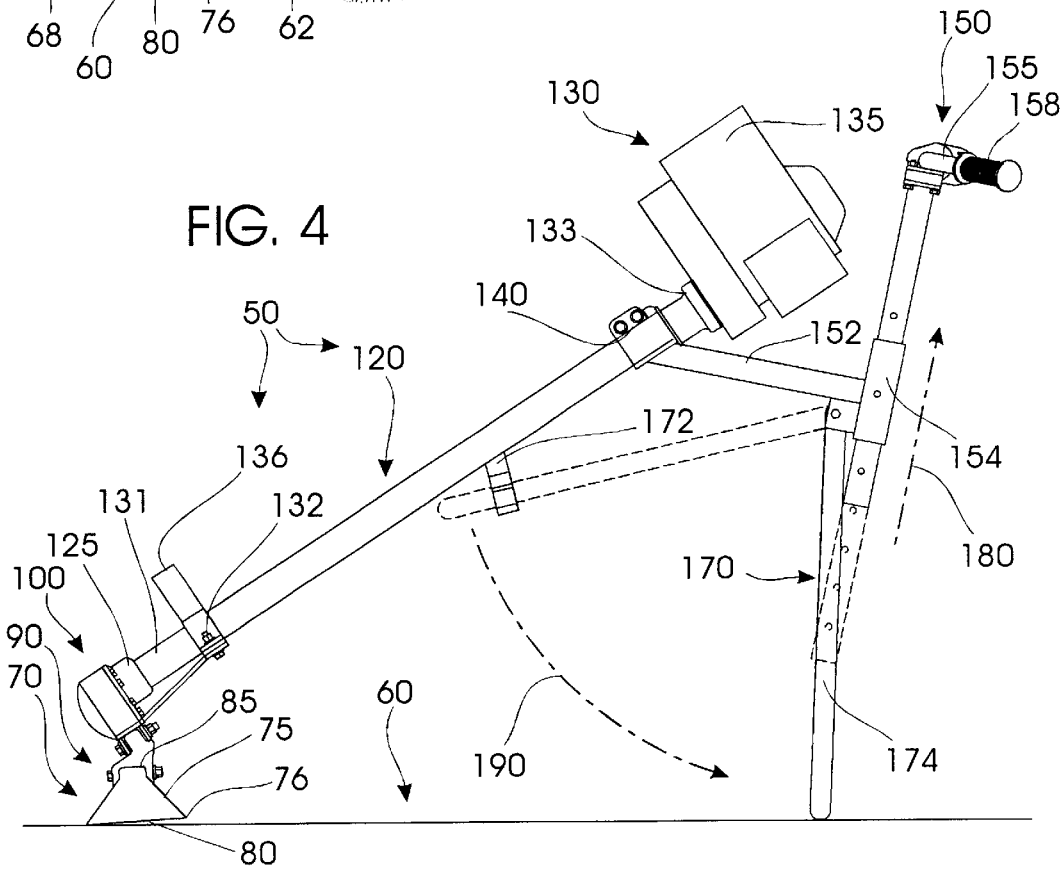
FIG. 4 is a side elevational view of the invention depicting optional screed deployments.
Figure 5:
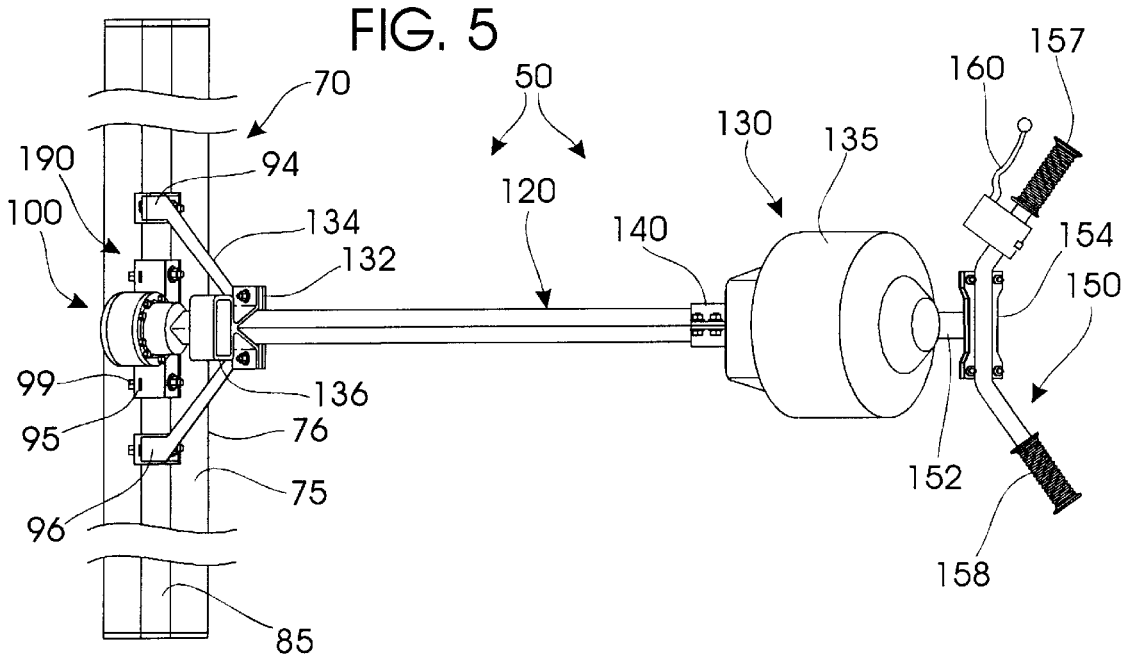
FIG. 5 is a top plan view of the invention.
Figure 6:
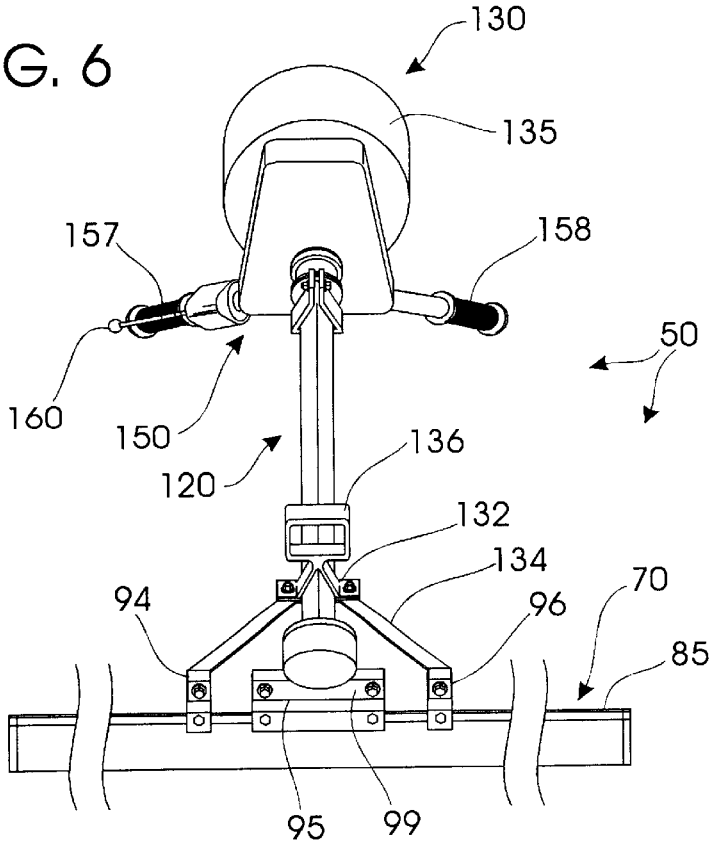
FIG. 6 is a front elevational view of the invention.
Figure 7:
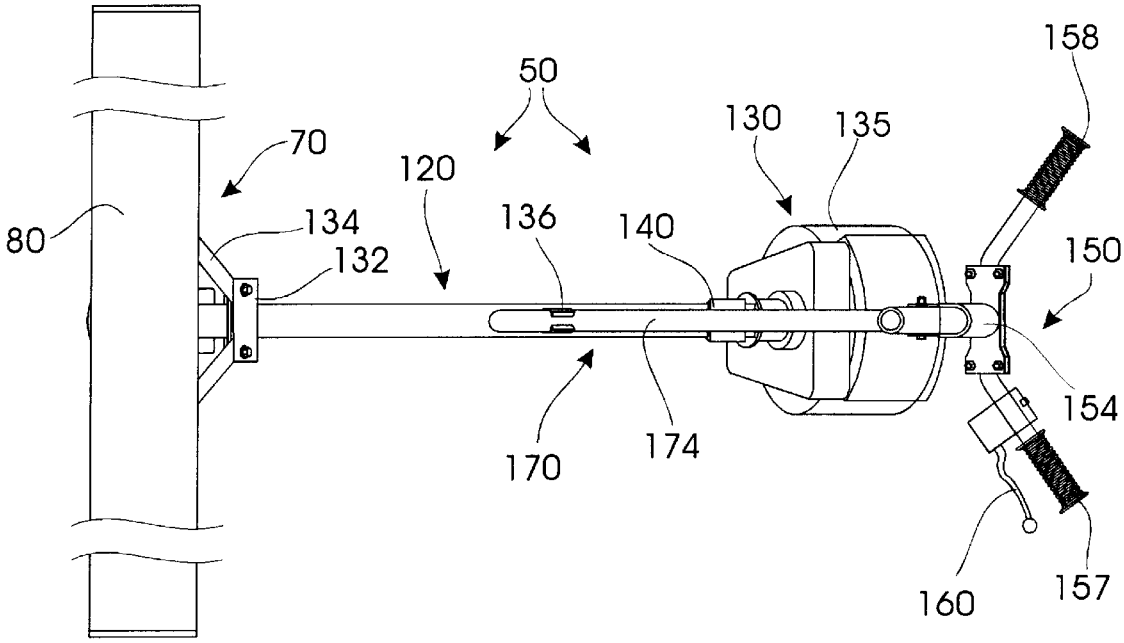
FIG. 7 is a bottom plan view of the invention.
Figure 8:
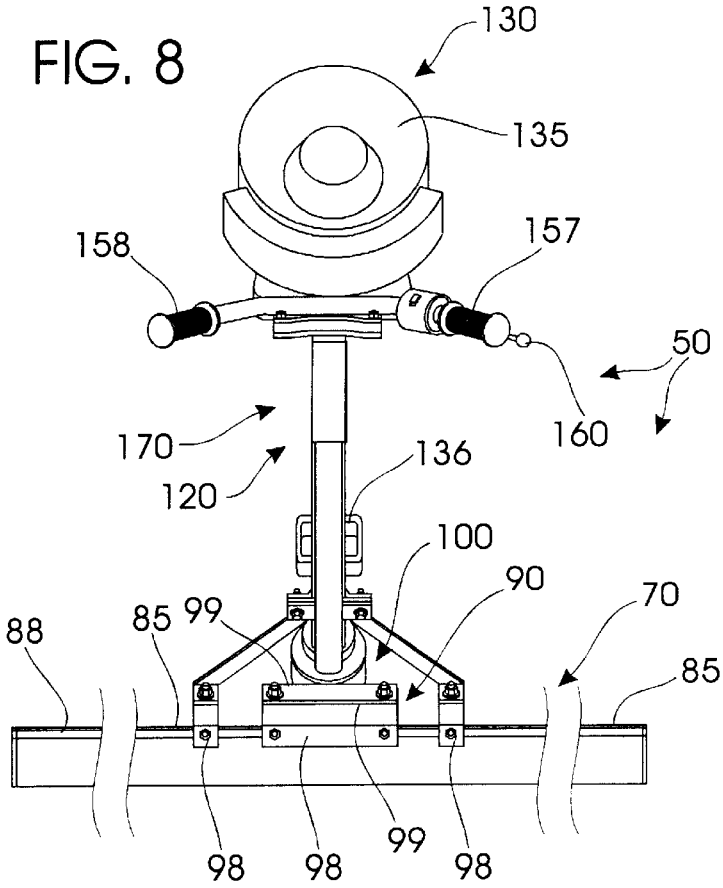
FIG. 8 is a rear elevational view of the invention.

The screed 50 may be manipulated by a single operator to vibrate, consolidate and level wet plastic concrete at a construction site 60 as is shown in FIGS. 1 and 3. The operator moves screed 50 along the upper surface 64 of the concrete monolith 62 in the direction indicated by arrow 55. As the screed 50 moves along the upper surface 64 it strikes off excess concrete 66 while it vibrates the concrete passing thereunder to consolidate it into a finished, substantially uniform monolith 68 with a relatively smooth top surface 69.

The excess concrete 66 is first encountered by the screed bar 70. The screed bar 70 strikes off the excess concrete 66 as the screed 50 is drawn across the concrete 62.

Bar 70 includes an elongated frame 72 that may be split into a strike-off 75 and a levelling plate 80. Preferably, strike-off 75 forms the leading edge of the bar 70 while levelling plate 80 forms the lower surface. Ideally, the outer periphery of bar 70 forms a truncated equilateral triangle with the uppermost portion of bar 70 forming an integral tubular duct 85.

Strike-off 75 comprises a blade 76 with an integral, upwardly sloping ramp. As the strike-off 75 encounters excess concrete 66, the excess concrete 66 is forced up the ramp until sufficient accumulation causes the deposit of excess concrete 66 in a recess 65 of the concrete as the screed 50 moves across the concrete 62.

The levelling plate 80 comprises a flat, elongated surface that is adapted to produce a smooth top layer 69. In a particular embodiment, bar 70 is approximately four to ten feet in length and levelling plate 80 is approximately two to twelve inches in width. In a preferred embodiment, bar 70 is 10' in length and plate 80 is 5.5" in width.

Preferably, a brace 85 with a rectangular cross-section extends substantially across the entire top of bar 70. An internal reinforcing bar may extend from the levelling surface 82 to the top to help transfer vibration from the brace 85 to the concrete. Brace 85 also facilitates mounting the screed 70 to a bar clamp 90 and a vibratory housing 100.

The screed bar 70 is forcefully vibrated by a vibratory housing 100. In a particular embodiment, the housing 100 is coupled to the bar 70 by a multi-component clamp assembly 90. Clamp assembly 90 includes spaced apart outer clamps 92 and 94 on either side of a central clamp 95.

Both of the outer clamps 42 and 94 and the central clamp 95 securely captivate the bar 70. Ends 92 and 94 and central clamp 95 are preferably coupled to elongated brace 85. Each 92, 94 and 95 clamp includes spaced-apart, parallel side walls 96 and 98 that slide over brace front and rear walls 86 and 88 to captivate bar 70. Each bar clamp portion is bolted to brace 85 to secure clamp 90 to brace 85. Clamp 90 further includes a central plate 99 that directly secures vibrational housing 100 to clamp 90. The clamp 90 is coupled to brace 85 via conventional bolts or guide couples.

The vibrational housing 100 comprises a flat, rigid, elongated plate 102 with appropriate holes that match the bolts or the like when plate 102 rests upon plate 99. A central vibration housing 105 secures upon plate 102. Housing 105 has several appropriate mounts (i.e. bolts or the like) securing it to plate 102. Housing 105 includes a lubricated vibration assembly 110.

Vibration assembly 110 comprises an internal eccentric weight assembly. The weight assembly comprises a forward steel bearing sleeve and a rear steel bearing sleeve. A central steel shaft extends between sleeves supported by forward bearing and rear bearing. An intermediate eccentric weight is sandwiched between the front and rear sleeves. The weight rides upon the shaft.

Ideally, the shaft is 0.5 inch by 2.35 inches and the eccentric weight is a disc weight 0.5 inch thick with a 3 inch diameter that has been drilled 3/16 inch to 1/4 inch off-center to accommodate the shaft. The front end of the shaft has a 3/16 inch square hole approximately 5/8 inch deep to accept a square drive shaft end as will be discussed more thoroughly hereinafter.

The weight assembly normally resides in housing 105 in a conventional cavity. Housing 105 preferably also includes a removable cover which seals the cavity when the housing 105 is assembled.

The vibration assembly 110 is coupled to an elongated shaft 120 extending from the motor 130 to the bar 70. An auxiliary bracket 132 further reinforces the vibration assembly with an A-frame brace 134. The brace 134 supports an transport handle 136.

The shaft 120 includes an elongated, body with an internal conduit for an internal flexible drive shaft. The shaft 120 is coupled to the vibration housing 110 by a collar 125. Several spaced-apart bolts affix the collar 125 to the shaft 130.

Shaft 130 includes a pair of spaced-apart ends 131 and 133 with an intermediate reinforcing bracket 132. Shaft end 131 is preferably adjacent vibration assembly 100 and preferably couples to vibration housing 110 via collar 125. Shaft end 133 preferably supports an internal combustion engine 135.

The internal combustion engine 135 rotates a drive collar which in turn rotates the eccentric weight via the internal shaft. The internal shaft extends from engine 135 to housing 105 inside shaft 120. Engine 135 preferably comprises a conventional four-cycle one-horsepower gasoline engine. Preferably, the engine is capable of sustaining revolutions in the amount of 2,000–4,000 rpms. Ideally, the engine is designed to turn 2,500 rpms nominally, and can be adjusted via throttle by the user for optimum operation in all various conditions. The shaft directly drives the weight so that the weight revolves in the same range.

The engine 135 is supported by an engine mount secured to the shaft by a locking collar 140. The locking collar 140 is integrally secured to a rearwardly protruding handlebar assembly 150 adapted to be manipulated by the user.

Handlebar assembly 150 comprises an offset frame 152 integrally secured to collar 140 and having an adjustable receiver 154. The receiver 154 adjustably secures the handlebar 155 and a pivoting kickstand 170 to the shaft 120. The handlebar height may be adjusted by raising or lowering the assembly 150 in receiver 154. As a result, the user may easily adjust the handlebar height to a comfortable operating elevation (as indicated by arrow 180). Handlebar 155 includes a crossbar 156 with terminal handlebar grips 157, 158 and throttle control lever 160.

Kickstand 170 comprises an elongated rod 172 that pivots between a stored and deployed position (as indicated by arrow 190). Kickstand 170 is held in the deployed position by a snap lock 174. When deploying the kickstand 170, the operator simply pulls down on rod 172 to disengage lock 174.

The operator may quickly deploy the kickstand 170 and then drop the screed 50 during an emergency situation or the like so that it rests solely on kickstand 170 and bar 70. The operator need not turn off the engine 135 if the absence is temporary. When so dropped, screed 50 will not harm previously consolidated concrete 68. Thus, a significant advantage is that the operator does not lose his place and does not need to rework already finished concrete.

The screed 50 disperses vibrations generated by the vibrational housing 100 directly to the bar 70 via clamp 90. The multi-component clamp 90 uses offset outer clamps 92 and 94 with the intermediate central clamp 95 to enhance the vibratory effect of the vibrational assembly 100. Since the outer clamps 92 and 94 are offset from the central clamp 95, during vibration they cause the bar 70 to vibrate more.

Preferably, clamp 90 is between 16 and 20 inches in length. A preferred length of the clamp to the is in the range of 16" to 18". An ideal ratio for the length of the clamp to the bar length is in the range of approximately 1 to 6. The present screed 50 does not employ complex transmission linkages to transfer vibrations along the bar length. As such, it is low maintenance and reliable. Also, the vibrational housing 100 is elevated above the screed bar 70 to avoid contact with wet concrete. Thus, the invention avoids or at least substantially limits, potential for penetration of the housing by destructive materials, such as sand or the like, resulting from regular contact with concrete.

Whereas, the present invention has been described in relation to the drawings attached hereto, it should be understood that other and further modifications, apart from those shown or suggested herein, may be made within the spirit and scope of this invention.

What is claimed is:

1. A lightweight, portable vibratory screed adapted to be used by an operator for striking off, consolidating and placing plastic concrete, said screed comprising:

an elongated screed bar having a top and a spaced apart flat bottom and an exterior intermediate ramp extending therebetween, said bottom adapted to finish the concrete and said ramp adapted to strike off said concrete;

a shaft with spaced apart ends, one of said spaced apart ends secured to said bar and supporting a vibrational assembly adjacent said bar and adjusted to selectively vibrate said bar, and the other of said ends remotely supporting motor means for said powering said vibrational assembly;

a clamp securing said shaft to said screed bar, said clamp comprising at least three sections adapted to captivate disparate portions of said screed bar top to enable said vibrational assembly to vibrate said screed bar; and wherein said screed bar top further comprises a brace having a rectangular cross-section and extending substantially across said screed bar top, said brace having integral portions captivated by said clamp.

2. The screed as defined in claim 1 further comprising an adjustable handle assembly mounted to said shaft adjacent said motor means, said handle assembly adapted to permit an operator to manipulate said screed.

3. The screed as defined in claim 2 wherein said handle assembly further comprises a pivoting kickstand that may be selectively deployed by the operator.

4. The screed as defined in claim 1 wherein said vibrational assembly comprises a vibrational housing offset from said screed bar by said clamp.

5. A lightweight, portable vibratory screed adapted to be used by an operator for striking off, consolidating and placing plastic concrete, said screed comprising:

an elongated screed bar having a top and a spaced apart flat bottom and an exterior intermediate ramp extending therebetween, said bottom adapted to finish the concrete and said ramp adapted to strike off said concrete, and said top comprises a brace having a rectangular cross-section and extending substantially across said screed bar, said brace having integral portions captivated by said clamp;

a shaft with spaced apart ends, one of said spaced apart ends secured to said bar and supporting a vibrational assembly adjacent said bar and adapted to selectively vibrate said bar, and the other of said ends remotely supporting motor means for said powering said vibrational assembly; and, a clamp securing said shaft to said screed bar, said clamp comprising at least three sections adapted to captivate disparate portions of said screed bar top to enable said vibrational assembly to vibrate said screed bar.

6. The screed as defined in claim 5 wherein said vibrational assembly comprises a vibrational housing offset from said screed bar by said clamp.

7. The screed as defined in claim 6 further comprising an adjustable handle assembly mounted to said shaft adjacent said motor means, said handle assembly adapted to permit an operator to manipulate said screed.

8. The screed as defined in claim 7 wherein said handle assembly further comprises a pivoting kickstand that may be selectively deployed by the operator.

9. A lightweight, portable vibratory screed adapted to be used by an operator for striking off, consolidating and placing plastic concrete, said screed comprising:

an elongated screed bar having a top and a spaced apart flat bottom and an exterior intermediate ramp extending therebetween, said bottom adapted to finish the concrete and said ramp adapted to strike off said concrete, and said top comprises a brace having a rectangular cross-section and extending substantially across said screed bar, said brace having integral portions captivated by a clamp securing said shaft to said screed bar, said clamp comprising at least three sections adapted to captivate disparate portions of said screed bar top to enable said vibrational assembly to vibrate said screed bar;

a shaft with spaced apart ends, one of said spaced apart ends secured to said bar and supporting vibration means for vibrating said bar and the other of said ends remotely supporting motor means for said powering said vibration means, said vibration means comprising a vibrational housing offset from said screed bar by said clamp; and an adjustable handle assembly mounted to said shaft adjacent said motor means, said handle assembly adapted to permit an operator to manipulate said screed.

10. The screed as defined in claim 9 wherein said handle assembly further comprises a pivoting kickstand that may be selectively deployed by the operator.

* * * * *